United States Patent [19]

de Rham

[11] Patent Number: 4,532,915

[45] Date of Patent: Aug. 6, 1985

[54] GAS TIGHT CHIMNEY ACCESS DOOR AND SHIELD FOR USE THEREWITH AND CHIMNEY ASSEMBLIES EMPLOYING SAME

[76] Inventor: Abbott B. de Rham, Stoney Meadow, Dorset, Vt. 05251

[21] Appl. No.: 500,639

[22] Filed: Jun. 3, 1983

[51] Int. Cl.[3] ..... F23J 13/08

[52] U.S. Cl. ..... 126/242; 52/19

[58] Field of Search ..... 126/140, 190, 202, 242; 110/173 R; 98/58, 1; 49/463; 52/19, 20, 21

[56] References Cited

U.S. PATENT DOCUMENTS

| | | | |
|---|---|---|---|
| 676,607 | 6/1901 | Green et al. | 110/173 R |
| 679,830 | 8/1901 | Carter et al. | 126/190 |
| 1,457,450 | 6/1923 | Matthews | 212/126 |
| 2,196,934 | 4/1940 | Morgan | 126/120 |
| 2,219,962 | 10/1940 | Reynolds et al. | 126/190 |
| 2,397,470 | 4/1946 | Cauchaner | 126/120 |
| 2,398,393 | 1/1946 | Paulette | 72/94 |
| 4,062,344 | 12/1977 | Mayes | 126/120 |
| 4,118,894 | 10/1978 | Kennedy et al. | 49/402 |
| 4,159,016 | 6/1979 | Johnson | 126/120 |
| 4,193,237 | 3/1980 | Jankowski | 52/19 X |
| 4,287,815 | 9/1981 | Henderson | 98/29 X |

FOREIGN PATENT DOCUMENTS

| | | | |
|---|---|---|---|
| 2236701 | 4/1973 | Fed. Rep. of Germany | 126/307 |
| 3024185 | 1/1982 | Fed. Rep. of Germany | 126/242 |
| 596951 | 1/1948 | United Kingdom | 126/190 |

*Primary Examiner*—Harold Joyce

[57] ABSTRACT

A chimney access door assembly for mounting on existing chimneys to permit convenient cleaning includes a frame member defining an aperture therein and which is mounted in the opening of the chimney and a closure member dimensioned to overlie and close the aperture in the frame member and extend about a marginal portion of the frame member about the aperture. Gasket means is provided between the adjacent surfaces of the closure member and frame member and extends about the frame member aperture so as to substantially prevent passage of smoke, fumes and the like. In one embodiment, the closure member is provided with a recess for seating on its inside surface insulating means for use of the access door assembly on an exterior wall. To permit cleaning with a minimal passage of dust and dirt passage outwardly of the opening the chimney, a dust cover may be substituted for the closure member, and the dust cover provides a sleeved opening for insertion of the cleaning tool and another aperture for removal of dust, soot and the like.

10 Claims, 7 Drawing Figures

GAS TIGHT CHIMNEY ACCESS DOOR AND SHIELD FOR USE THEREWITH AND CHIMNEY ASSEMBLIES EMPLOYING SAME

BACKGROUND OF THE INVENTION

The present invention relates to a chimney access door assembly for mounting in chimneys to provide means for effecting convenient cleaning thereof.

As is well known, tars, soot and the like will accumulate on the walls of the chimney during a period of extensive or extended usage. With the increase use of fireplace inserts and other heating devices utilizing wood and like fuels, there has been an increasing need to provide a means for cleaning the chimney to avoid fires and to ensure that the chimney will conveniently and effectively transport smoke and fumes from the dwelling.

Because of difficulties in cleaning chimneys, it has generally been necessary to employ the services of a professional chimney sweep with specialized equipment to permit full and effective cleaning of the chimney. Homeowners who have attempted to clean their own chimneys have frequently encountered difficulties in working from the roof in order to utilize the types of equipment presently available for convenient cleaning. In some instances, it has been necessary to disassemble the flue and/or to remove fireplace inserts in order to effect cleaning from inside the house.

In addition, there has been a substantial problem from the standpoint of the cleaning process because of the necessity to ensure that the chimney opening is effectively sealed so that soot, dust and the like do not exit from the chimney and into the room atmosphere.

It is an object of the present invention to provide a novel and highly effective chimney access door assembly which may be mounted in conventional chimneys in a manner which will not interfere with fireplace inserts, flues and the like.

It is also an object to provide such a chimney access door assembly which may be readily and economically fabricated and which will permit the homeowner to utilize conveniently available tools to effect cleaning of the chimney from within the dwelling.

Another object is to provide such a chimney access door assembly including means for minimizing the likelihood of escape of soot, dust and the like into the dwelling during the cleaning process.

SUMMARY OF THE INVENTION

It has not been found that the foregoing and related objects may be readily attained in a chimney access door assembly for mounting in a chimney which includes a frame member defining an aperture therewithin and means for mounting the frame member in the associated chimney opening. The frame member has a face portion for disposition against the outer surface of the chimney, and a mounting portion extending generally perpendicularly thereto for disposition against the side surfaces of the chimney opening. Disposed over the aperture of the frame member is a closure member dimensioned to encompass the aperture and to overlie at least the peripheral area portion of the face portion of the frame member. Gasket means is provided between the opposed surfaces of the closure member and frame member face portion, and extends about the frame member aperture. Disengageable means is provided to fasten the closure member securely to the frame member.

In the preferred embodiment, the face portion of the frame member has a lip extending from adjacent its outer edge substantially parallel to the mounting portion to define a channel in combination therewith and to space the face portion outwardly from the outer wall of the associated chimney, and thereby provide a concealed recess. The disengageable fastening means includes threaded fasteners having heads disposed in this channel and shanks which extend through the frame member face portion and the closure member. Lock members are threadably engaged on the ends of the shanks outwardly of the closure member.

Desirably the surface of the overlying portions of one of the closure member or the frame member face portion has a recess therein to seat the gasket means and ensure proper seating and sealing action.

The closure member preferably has a lip on its inner face extending inwardly of the frame member aperture and thereabout to define a inwardly facing recess. In this recess is disposed insulating means; and a cover extends over the insulating means and is secured against the lip by suitable securing means.

During the cleaning operation, the closure member is removed and a dust cover of flexible material is substituted therefor. The dust cover is dimensioned to overlie the frame member aperture upon removal of the closure member, and it includes mounting means cooperating with the mounting means for the closure member in order to effect mounting thereof on the frame member. The dust cover includes at least one aperture for insertion therethrough of tools for cleaning the chimney. This aperture in the dust cover desirably has a sleeve of flexible material thereabout which extends outwardly therefrom for insertion of the cleaning tool therethrough, and the sleeve may be collapsed about the cleaning tool to minimize exiting of soot, dust and the like. Preferably the dust cover has another aperture with a closure therefor and engaging means extending thereabout, so that this aperture may be kept closed except as required.

To facilitate mounting of the dust cover, the dust cover and mounting means includes apertures in the cover for passage of the closure member mounting means therethrough and reinforcing means extending about these apertures. To facilitate mounting of the cover, it desirably includes stiffening means extending about its periphery which enables the unit to be handled more conveniently and mounted upon the mounting members of the frame.

Desirably, the frame member periphery is of generally rectangular configuration and the aperture therein has a lower portion of rectangular configuration and an upper portion of arched configuration. In turn, the closure member is cooperatively configured to overlie the aperture.

DETAILED DESCRIPTION OF THE ILLUSTRATED EMBODIMENTS

Figure 1:
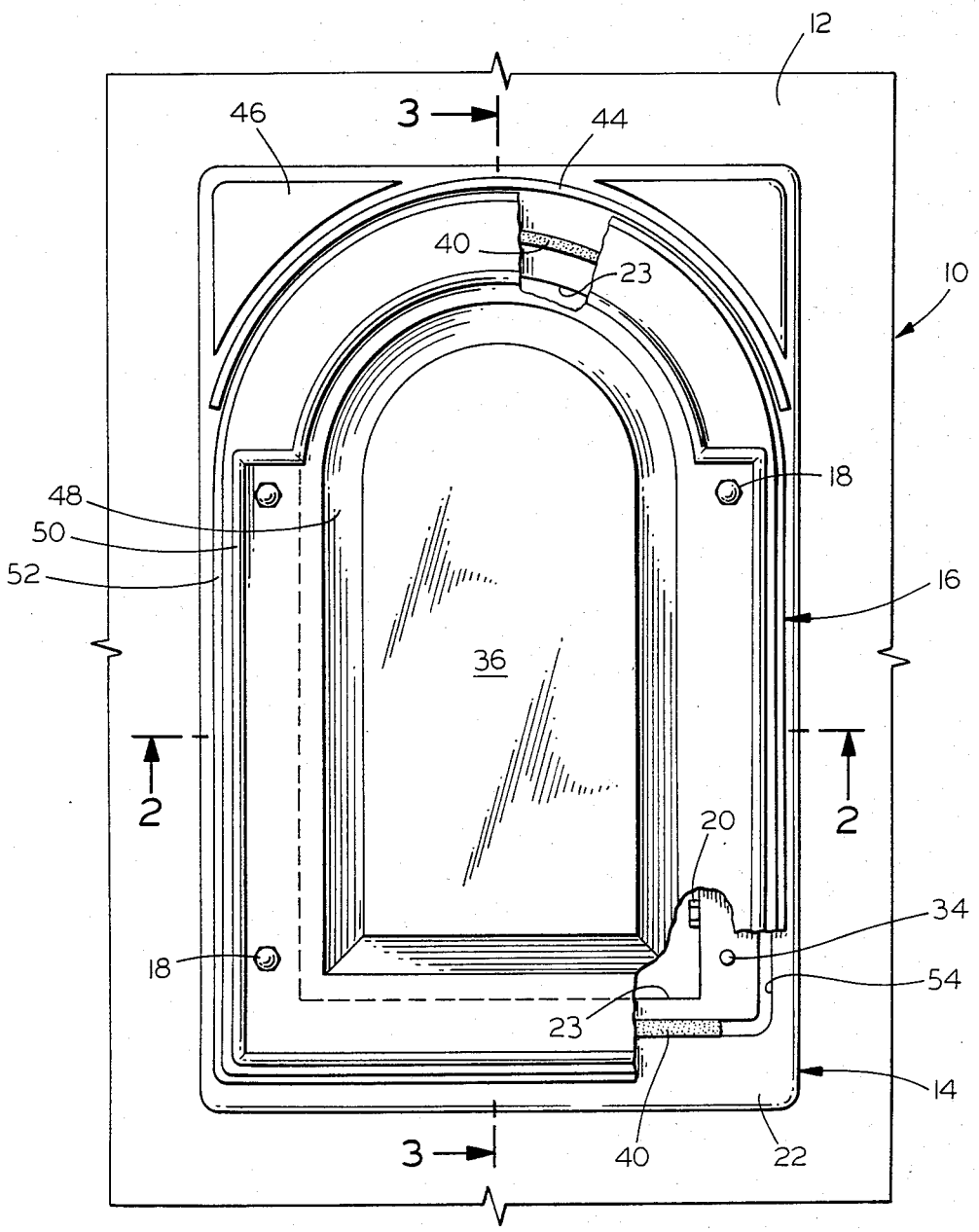
FIG. 1 is a fragmentary elevational view of a chimney upon which has been mounted a chimney access door assembly embodying the present invention, with portions of the door assembly broken away to reveal internal construction.

Turning first to FIG. 1 of the attached drawings, a chimney generally designated by the numeral 10 has a sidewall 12 in which is mounted a chimney access door assembly embodying the present invention. The assembly is comprised of the frame member generally designated by the numeral 14 and the closure member generally designated by the numeral 16 and secured to the frame member 14 by fasteners of which the nuts 18 may be seen. Lag bolts 20 extend through the sides of the frame member 14 into the wall of the chimney 10 to secure it in the opening.

Turning now in detail to the frame member 14, it can be seen to be of generally rectangular peripheral configuration which is defined by the face portion 22, the inner leg portion 24 which extends along the inside face 26 of the opening made in the chimney 10 and the outer leg portion 28 which is of considerably shorter length and abuts against the sidewall face 12. The outer leg portion 28 effects a spacing of the face portion 22 from the chimney wall 12 and thus provides a recess 30 defined by the face and leg portions. Seated in the recess 30 are the heads 32 of the bolts which have thin shanks 34 extending through apertures in the face portion 22 and through the closure member 16, with the nuts 18 being secured on the outer ends thereof. As can be seen the lag bolts 20 extend through the inner leg portions 24 of the frame member 14 into the inside faces 26 of the chimney opening. As best seen in FIG. 1, the frame member provides a generally arched-shaped opening 23 (seen partially in dotted line) by virtue of the arch-shaped header portion 46 which extends across the upper portion thereof, and an arched lip 44 extends outwardly from the face of the arched portion 46 above the opening 23 in the frame member 14.

Figure 2:
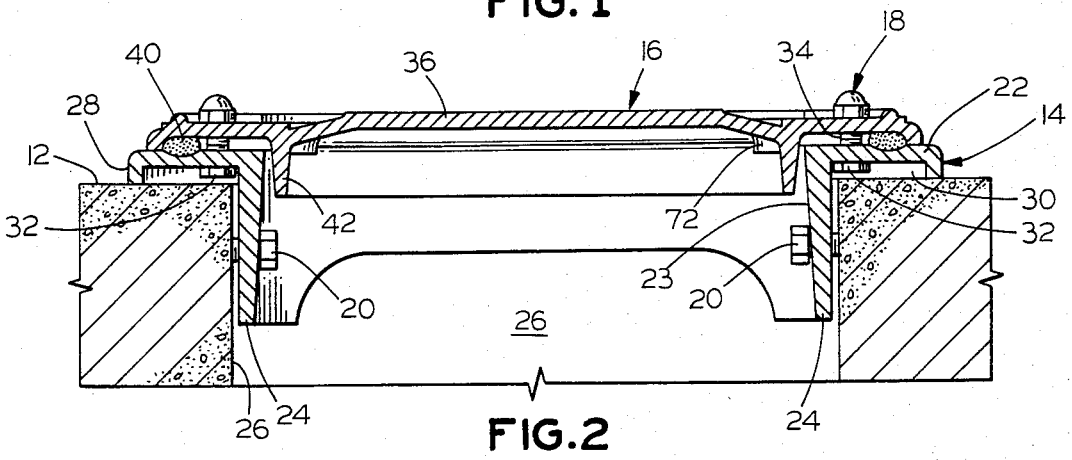
FIG. 2 is a fragmentary sectional view thereof along the line 2—2 of FIG. 1.
Figure 3:
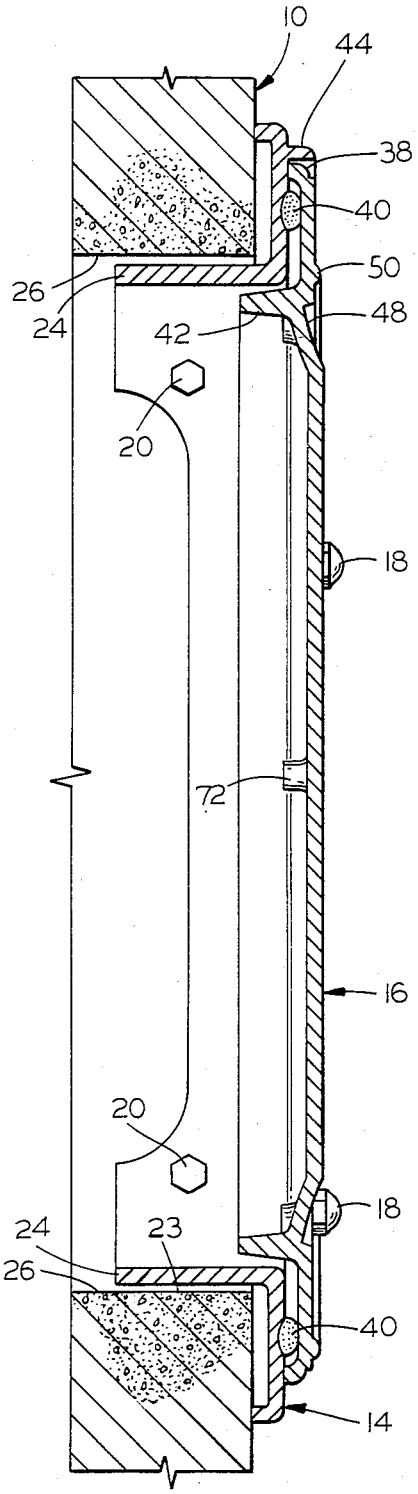
FIG. 3 is a fragmentary sectional view thereof along the section line 3—3 of FIG. 1.

The closure member 16 is cooperative configured with respect to the arch-shaped opening 23 of the frame member 14 and thus is generally arched-shaped. It includes the face portion 36 which has ornamental ribs 48, 50 and 52 formed therein. As seen in FIGS. 2 and 3, a peripheral lip 38 is provided thereabout and abuts against the face portion 22 along the sides, and header portion 46 along the top of the frame member 14, thus providing a minor spacing between the inner surface of its face portion 36 and the face portion 22 of the frame member 14.

Disposed in the space between the face portion 22 of the frame member and the face portion 36 of the closure member 16 is a gasket 40 of resiliently compressible material which effects a seal about the opening in the frame member 14 to substantially prevent escape of gases and the like into the atmosphere. For optimum seating of the gasket and sealing the face portion 22 of the frame member 14 is provided with a shallow recess 54, in which the insulating gasket 40 seats and the gasket 40 held in place on the closure member 16 by a high temperature adhesive.

Figure 4:
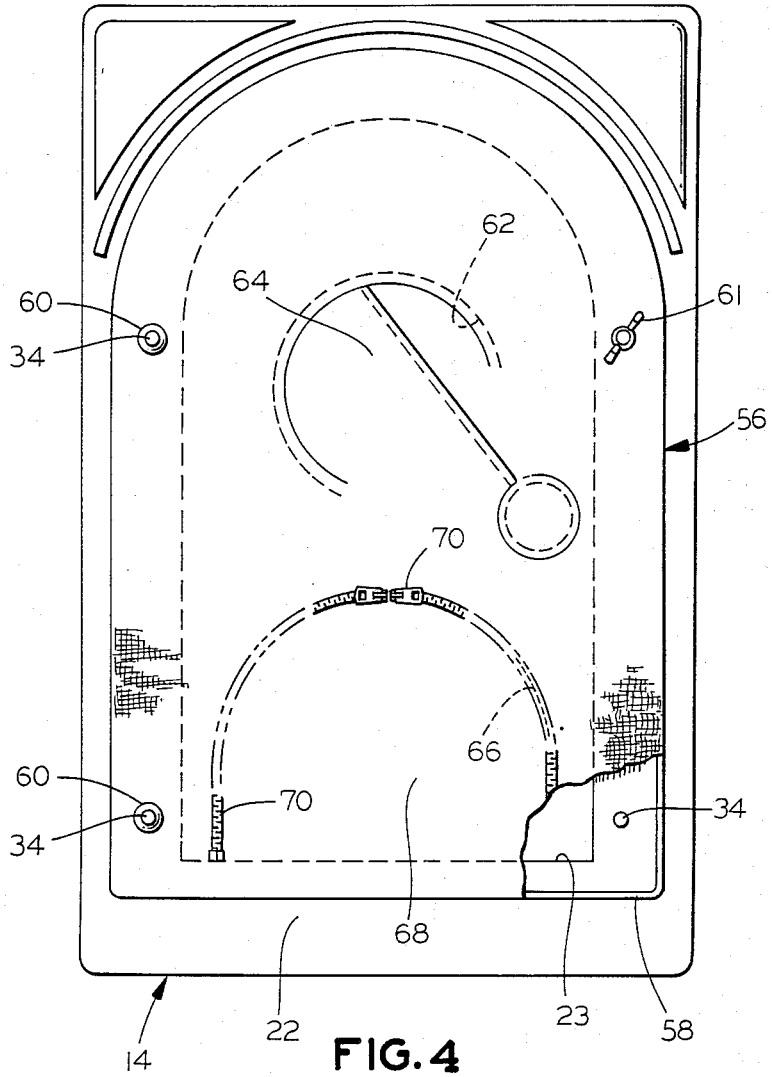
FIG. 4 is an elevational view of the chimney door assembly with the dust cover substituted for the closure member and with a portion of the dust cover broken away to reveal internal construction.

When it is desired to effect cleaning of the chimney 10, the nuts 18 are removed and the closure member 16 is pulled off the shanks 34 of the fasteners. As seen in FIG. 4, a dust cover generally designated by the numeral 56 is substituted therefor and has a peripheral configuration which generally follows the opening 23 in the frame member 14 and overlies the adjacent surfaces of the frame member 14. Sewn into the periphery of the dust cover 56 is a stiffening wire rod 58 which provides sufficient rigidity to the cover 56 for easy handling thereof during the mounting and dismounting operations. Also attached to the cover 56 are grommets 60 or the like to reinforce the fabric material about the mounting apertures therein and through which the shank portions 34 of the bolts extend. After the dust cover 56 has been mounted upon the bolt shanks 34, the wing nuts 61 are threaded onto the shanks 34 to secure the dust cover 56 tightly in place against the face 22 of the frame member 14.

In the upper portion of the dust cover 56 is provided a first aperture 62 of generally circular configuration and sewn or otherwise secured to the marginal portions of the fabric about the aperture 62 is a sleeve of generally frustro-conical configuration 64 which is formed of flexible material and which tapers outwardly from the body of the cover 64 to a reduced opening at its outer end.

In the lower portion of the dust cover 56 is a second aperture 66 of generally arch-shaped configuration which is formed by a flap 68 which may be opened or closed by the releasable fasteners or zippers 70 extending about its periphery. This aperture 66, when opened, permits ready access to the lower portion of the opening 23 defined by the frame member 14.

Figure 5:
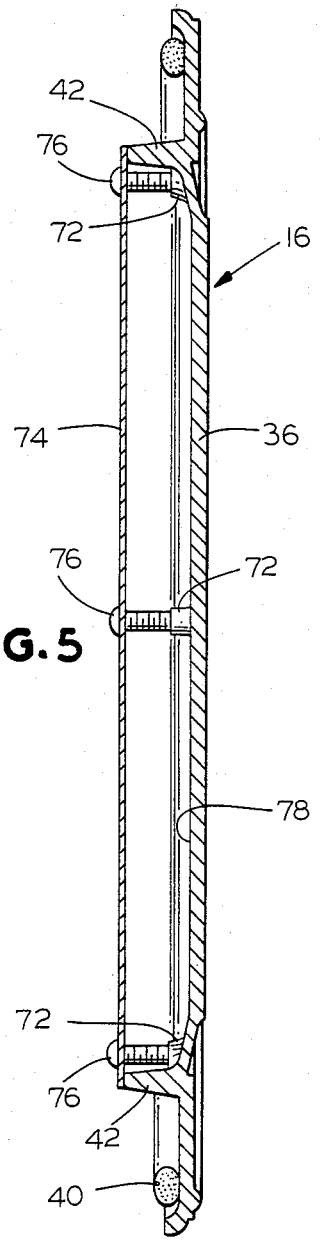
FIG. 5 is a sectional view of the closure member drawn to an enlarged scale and showing the insulating material cover mounted thereon.
Figure 6:
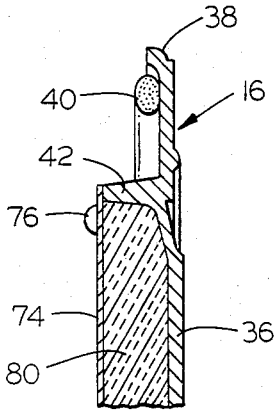
FIG. 6 is a fragmentary sectional view showing the insulating means disposed in the cavity of the closure member and under the insulating cover.
Figure 7:
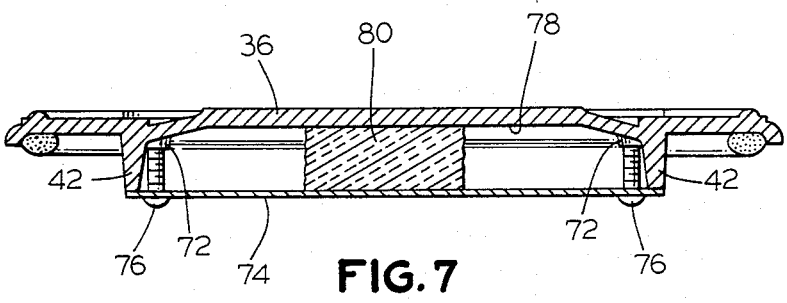
FIG. 7 is a transverse sectional view of the closure member and insulating cover with a portion of the insulating material illustrated therein.

Turning now to FIGS. 5–7, therein illustrated is additional means for minimizing the amount of heat transfer through the chimney access door assembly. The closure member 16 has on the inner surface of its face portion 36, an inwardly projecting insulating lip 42 extending inwardly of the opening 23 in the frame member 14 and defining an inwardly facing recess or cavity 78 therewithin. Bosses 72 are formed on the inside surface of the face portion 36 inwardly of the insulating lip 42.

A sheet metal cover 74 is dimensioned and configured cooperatively with respect to the insulating lip 42 so as to seat thereon and cover the recess 78. Threaded fasteners 76 extend through apertures in the cover 74 and threadably engage in the bosses 72 of the closure member 16. As best seen in FIG. 6, insulating material 80 is provided within the recess 78 and is covered by the cover member 74. As a result, a substantial portion of the surface of the closure member 16 has insulating material 80 minimizing heat transfer between the chimney access door assembly inner surface and the exterior surface of the assembly.

To effect mounting of chimney access door assembly of the present invention, it is necessary to make an opening of the appropriate size in the chimney wall. This opening may be at any point in the chimney providing convenient access except where fireplace inserts or stoves disposed within the fireplace opening limit access. For such installations, it is desirable to install the assembly above the mantel indoors or above the smoke shelf on the outside wall of the chimney. Since the gasketing about the assembly closure member provides an effective seal, there is no interference with the draft in the chimney.

After the appropriate size opening has been made, the frame member is placed in the opening and the locations of the lag bolts are marked on the inside surface of the chimney opening. The frame member is then removed and holes are drilled into the masonry of the chimney using a masonry bit. The frame member is then reinserted into position and secured in place by the lag bolts.

Since the shanks of the fasteners for securing the closure member on the frame member are threaded through the closure member, they are held in place and, when the closure member is placed thereon, the nuts can be threaded into tight engagement because the heads of the fasteners are substantially prevented from rotation.

When it is desired to effect cleaning, the nuts are removed from the fasteners and the closure member is lifted off. The dust cover is then placed thereon and secured to the surface of the frame member by placing the wing nuts on the fasteners. A brush of substantial size can be passed through the frustro-conical sleeve into the chimney opening and moved upwardly and downwardly as required to effect cleaning of the chimney walls. If so desired, the outer end portion of the sleeve can be collapsed about the rod portion of the brush to minimize the passage of soot or the like through the opening therein.

The flap at the bottom portion of the cover can be opened to insert a large vacuum for withdrawing the soot and the like being dislodged from the walls. Alternatively, after the cleaning operation has been completed, it may be opened for purposes of inserting a shovel or the like to scoop out the dislodged debris. After the cleaning operation has been completed, the dust cover can be removed, cleaned and stored. The closure member is reapplied and secured in position to again provide an airtight assembly.

The closure member installation of FIGS. 5–7 is particularly desirable when the assembly is to be placed on an outside wall of the chimney where cooling due to low outside temperatures might cause creosote or the like to condense upon and substantially foul, the inner surface of the closure member. The insulating material in this particular embodiment substantially reduces direct heat transfer and minimizes the amount of surface which might be chilled substantially by the outside temperature gradient.

As would be readily appreciated, both the frame member and the closure member can be conveniently fabricated by casting, and the subsequent drilling and threading operations may be readily performed.

The materials for fabricating the frame member and closure member are conveniently grey iron or other suitable cast iron materials. However, if so desired, steel and stainless steel may be employed, albeit at greater cost. The sheet metal cover is conveniently fabricated from steel. The fasteners for securing the several elements of the door assembly together are conveniently stainless steel, or bronze or brass, depending upon the location. Steel lag bolts are utilized for securing the frame member in the chimney opening.

The gasket material is desirably a resiliently compressible fiberglass rope, on the order of $\frac{1}{4}$ to $\frac{1}{2}$ inch in thickness. It may be secured to the surface of the frame member by a high temperature cement.

The insulation provided within the recess on the inside surface of the closure member is conveniently a high temperature fiberglass mat.

Thus, it can be seen from the foregoing detailed specification and attached drawings that the chimney access door assembly of the present invention provides a simple and convenient means for gaining access to the chimney without interfering with the draft or utilization of various components such as fireplace inserts and stoves which might be inserted therein. Depending upon the installation and the appliances utilized in the chimney, the access door assembly may be mounted in the inside of the house or on the outside chimney wall. Moreover, the assembly provides a dust cover which can be substituted for the closure to permit substantial sealing of the access opening during the cleaning operation. The several components may be readily fabricated at relatively low cost and provide a durable and easily used structure.

Having thus described the invention, I claim:

1. A chimney access door assembly for mounting in a chimney opening for convenient cleaning thereof comprising:

A. a frame member defining an aperture therewithin, said frame member having a face portion for disposition against the outer surface of the chimney and a mounting portion extending generally perpendicularly thereto for disposition against the side surfaces of the chimney opening, said mounting portion being of a length less than the thickness of the wall of the chimney;

B. fastener means in said mounting portion extending generally perpendicularly therethrough for mounting said frame member in an associated chimney opening by engagement in the chimney wall defining the opening;

C. a closure member dimensioned to close said aperture of said frame member and to overly at least the marginal portion of said face portion extending about said aperture;

D. gasket means between the opposed surfaces of said closure member and frame member face portion and extending about said frame member aperture; and E. disengageable threaded fastening means on said closure member and said face portion of said frame member about said aperture for fastening said closure member securely to said frame face portion of said member about said aperture.

2. The door assembly in accordance with claim 1 wherein said face portion of said frame member has a lip extending from its outer edge substantially parallel to said mounting portion to define a channel and to space said face portion outwardly from the outer wall of the associated chimney and provide a concealed recess, said disengageable fastening means including threaded fasteners having heads disposed in said channel and shanks extending through said frame member face portion and said closure member, and locking members threadably engaged on the ends of said shanks.

3. The door assembly in accordance with claim 1 wherein one of the adjacent surfaces of the overlying portions of said closure and frame member face portions has a recess therein seating said gasket means.

4. The door assembly in accordance with claim 1 wherein said closure member has a lip on its inner face spaced from its periphery and extending inwardly of said frame member aperture and thereabout to define an inwardly facing recess, said door assembly additionally including insulating means in said recess of said closure member.

5. The door assembly in accordance with claim 4 wherein said door assembly includes a cover extending over said insulating means, and means securing said cover against said lip.

6. The door assembly in accordance with claim 1 wherein said frame member has a periphery of generally rectangular configuration and wherein said aperture thereof has a lower portion of rectangular configuration and an upper portion of arched configuration, and wherein said closure member is cooperatively configured with respect to said aperture.

7. A chimney access door assembly for mounting in a chimney opening for convenient cleaning thereof comprising:

A. a frame member defining an aperture therewithin, said frame member having a face portion for disposition against the outer surface of the chimney and a mounting portion extending generally perpendicularly thereto for disposition against the side surfaces of the chimney opening, said mounting portion being of a length less than the thickness of the wall of the chimney, said face portion of said frame member having a lip extending from its outer edge substantially parallel to said mounting portion to define a channel and to space said face portion outwardly from the outer wall of the associated chimney and provide a concealed recess;

B. fastener means in said mounting portion extending generally perpendicularly therethrough for mounting said frame member in an associated chimney opening by engagement in the chimney wall defining the opening;

C. a closure member dimensioned to close said aperture of said frame member and to overlying at least the marginal portion of said face portion extending about said aperture;

D. gasket means between the opposed surfaces of said closure member and frame member face portion and extending about said frame member aperture, one of the adjacent surfaces of the overlying portions of said closure and frame member face portions having a recess therein seating said gasket means; and E. disengagable threaded fastening means on said closure member and said face portion of said frame member about said aperture for fastening said closure member securely to said face portion of said frame member about said aperture.

8. The door assembly in accordance with claim 7 wherein said disengageable fastening means includes threaded fasteners having heads disposed in said channel and shanks extending through said frame member face portion and said closure member, and locking members threadably engaged on the ends of said shanks.

9. A chimney access door assembly for mounting in a chimney opening for convenient cleaning thereof comprising:

A. a frame member defining an aperture therewithin, said frame member having a face portion for disposition against the outer surface of the chimney and a mounting portion extending generally perpendicularly thereto for disposition against the side surfaces of the chimney opening, said mounting portion being of a length less than the thickness of the wall of the chimney;

B. fastener means in said mounting portion extending generally perpendicularly therethrough for mounting said frame member in an associated chimney opening by engagement in the chimney wall defining the opening;

C. a closure member dimensioned to close said aperture of said frame member and to overlying at least the marginal portion of said face portion extending about said aperture, one of the adjacent surfaces of the overlying portions of said closure and frame member face portions having a recess therein seating said gasket means, said closure member having a lip on its inner face spaced from its periphery and extending inwardly of said frame member aperture and thereabout to define an inwardly facing recess;

D. insulating means in said recess of said closure member;

E. a cover extending over said insulating means;

F. means securing said cover against said lip; and

G. disengageable threaded fastening means on said closure member and said face portion of said frame member about said aperture fastening said closure member securely to said face portion of said frame member about said aperture.

10. The door assembly in accordance with claim 9 wherein said face portion of said frame member has a lip extending from its outer edge substantially parallel to said mounting portion to define a channel and to space said face portion outwardly from the outer wall of the associated chimney and provide a concealed recess, and wherein said disengageable fastening means includes threaded fasteners having heads disposed in said channel and shanks extending through said frame member face portion and said closure member, and locking members threadably engaged on the ends of said shanks.

* * * * *